US006505485B1

(12) United States Patent
Eiseberg

(10) Patent No.: US 6,505,485 B1
(45) Date of Patent: Jan. 14, 2003

(54) MESH IN THE PRODUCTION OF WOMEN'S HOSIERY

(76) Inventor: José Eiseberg, 24, Avenue Princesse Grace, Monte-Carlo MC 98000 (MC)

( * ) Notice: Subject to any disclaimer, the term of this patent is extended or adjusted under 35 U.S.C. 154(b) by 0 days.

(21) Appl. No.: 09/995,592

(22) Filed: Nov. 29, 2001

(30) Foreign Application Priority Data

Oct. 31, 2001 (MC) ..... 2476

(51) Int. Cl.[7] ..... D04B 1/00
(52) U.S. Cl. ..... 66/178 R; 66/169 A
(58) Field of Search ..... 66/169 A, 172 R, 66/178 R, 178 A, 172 E, 180

(56) References Cited

U.S. PATENT DOCUMENTS 2,100,861 A * 11/1937 Lochhead ..... 66/169 A
2,190,409 A * 2/1940 Maier ..... 66/109
2,379,649 A * 7/1945 Nebel ..... 66/169 A
3,131,556 A * 5/1964 Nebel ..... 66/169 A
3,157,037 A * 11/1964 Nebel et al. ..... 66/169 A
3,197,978 A * 8/1965 Scheeler ..... 66/169 A
3,287,938 A * 11/1966 Knohl ..... 66/169 A
3,319,440 A * 5/1967 Nebel et al. ..... 66/169 A
3,841,115 A * 10/1974 Kejnovsky et al. ..... 66/169 A
4,494,388 A * 1/1985 Lau et al. ..... 66/169 A
5,115,650 A * 5/1992 Patrick et al. ..... 66/169 A
5,426,957 A * 6/1995 Yamaoka ..... 66/169 A

* cited by examiner

*Primary Examiner*—Danny Worrell
(74) *Attorney, Agent, or Firm*—Young & Thompson

(57) ABSTRACT

Run-free hosiery made of the combination of a loop-shaped mesh, composed of an inter-mesh and a smooth rectilinear mesh, this combination having been achieved by knitting the mesh chain from two threads, one made of any other existing threads for weaving and one of elasthane, in one operation, creating a double-loop, with the specific function of the elasthane which tends to draw near the loops of the smooth mesh, thereby blocking the continuation of the run.

1 Claim, 6 Drawing Sheets

MESH IN THE PRODUCTION OF WOMEN'S HOSIERY

BACKGROUND OF THE INVENTION

An intertwining of curvilinear threads and a single component element is sufficient for the formation (from needles and plates) of a mesh, thereby replacing the traditional system of creating mesh by way of weft (horizontal) and warp (vertical) by loom (see NL-A-6 702 591).

Each mesh is linked to the next by way of an inter-mesh. A mesh is composed of the upper arc called the head or loop of the needle, of two lower half-circles called the feet of the loop or the loops of the plate, and two wings or columns that link the head to the feet (see FIG. 1).

FIG. 1 illustrates a mesh in which 1 indicates the loop formed by the needle, 2 the rectilinear columns, 4 the loops formed by the plate which combine to form the inter-mesh 3.

The principal type of intertwining used in the production of women's hosiery is the smooth mesh (see FIG. 2).

In FIG. 2, one can note how the smooth mesh is remarkably well endowed with elasticity because the inter-mesh, not having been blocked, allows the thread to slide freely in whichever direction, following the type of external prompting.

The elasticity acquired from this system of creating mesh carries with it, however, a considerable handicap: mesh that runs.

After a thread breaks at any point, it causes, due to the lack of a blocked intermesh, a run (ladder) which continually repeats (vertically) (see FIG. 3).

Run-free is the term for the intertwining which, by its own constitution, as opposed to the mesh that runs, blocks the head of the mesh.

The methods, in use, are based on links in the form of loops, plated, transported, dropped stitches, etc., which, in whatever way, "close" the mesh that runs, as opposed to a barrier to the running of the mesh. The system the most diffuse in the production of women's hosiery is that of the loop-shaped mesh.

These selections, which are presented arranged in a draughtboard (checkerboard), stop the run because:

a) it is obligatorily engaged in an area that is divided and non-rectilinear;

b) as seen in FIG. 4, the heights of the links are different, which, consequently, causes shrinkage in the "mouths" of the inter-mesh.

Though having attained a high level of protection against runs, since the opening of the narrow canal of the inner-mesh stops, because of major friction, the dynamic of the thread, this product presents a low coefficient of elasticity. Another inconvenience of the aforementioned mesh, is its feel, very woolly, in comparison to the smooth mesh.

SUMMARY OF THE INVENTION

Current technology has allowed for the deeper study of traditional run-free systems and we have arrived at the creation of a new type of mesh which we have called "JOSÉ EISENBERG-LIFE RUN-FREE," extraordinary in every sense, because it presents a perfect fusion of the qualities of the smooth mesh and those of the traditional run-free system.

DESCRIPTION OF THE PREFERRED EMBODIMENTS

Figure 1:
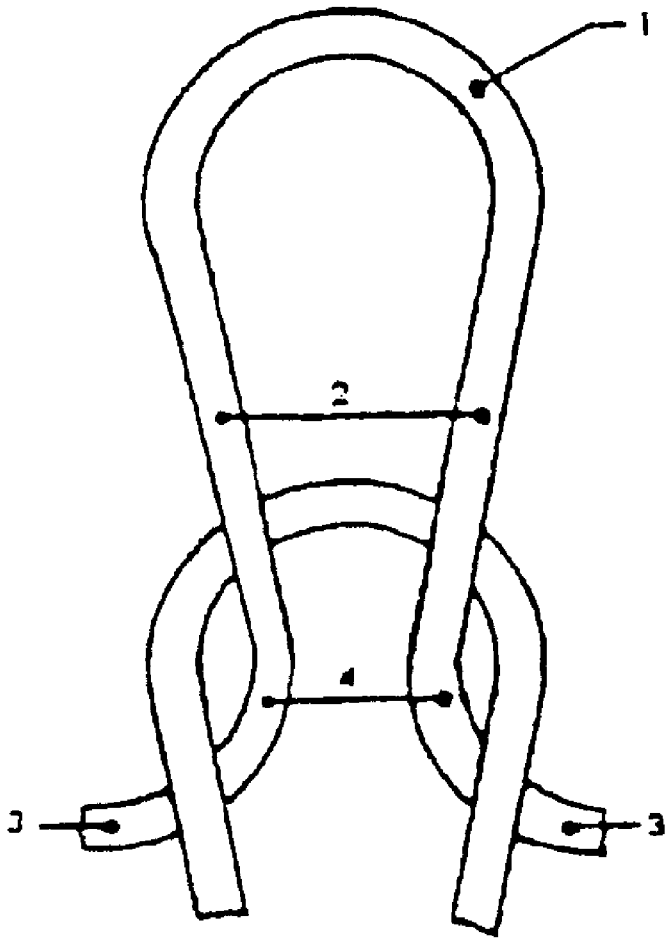
Figure 1 (PRIOR ART)
FIG. 1 is a schematic illustration of an inter-mesh hose of the prior art.
Figure 2:
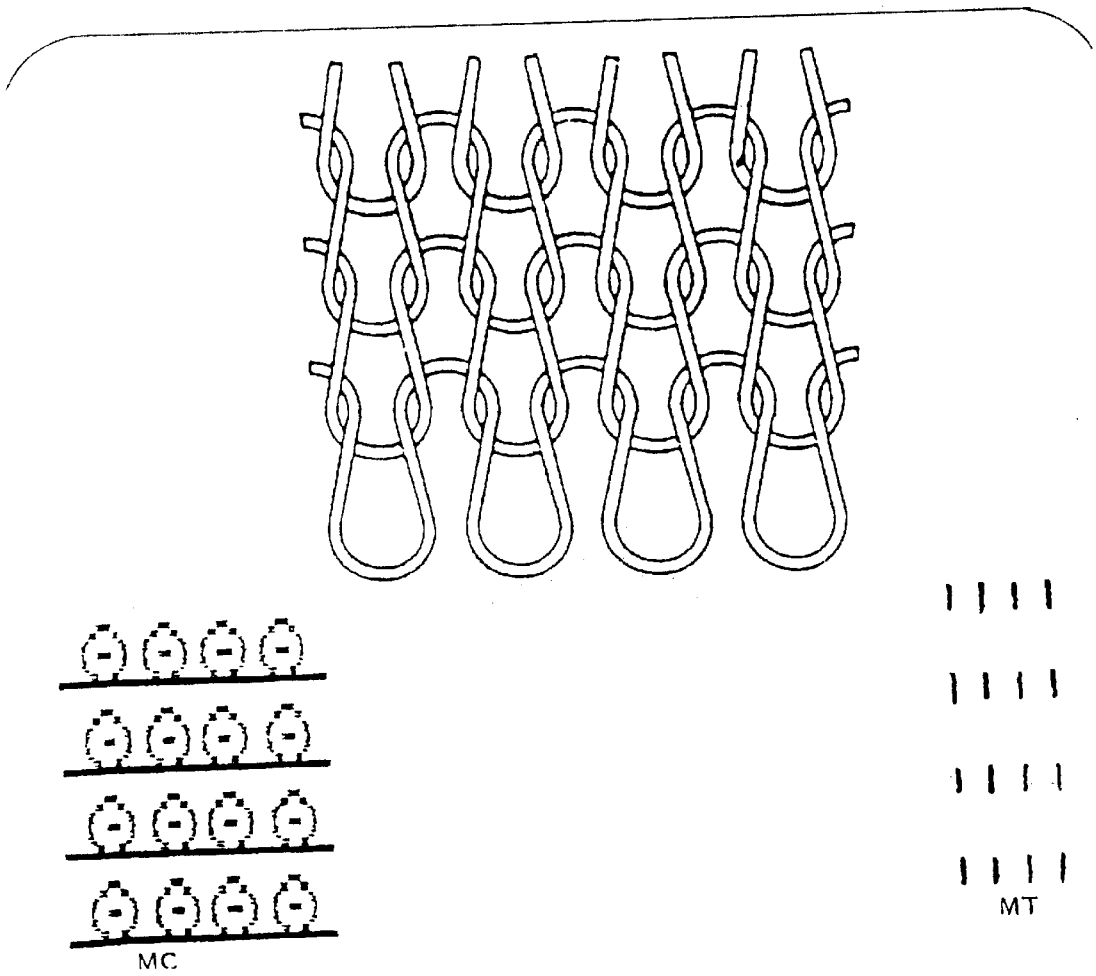
Figure 2 (PRIOR ART)
FIG. 2 is a schematic illustration of a smooth mesh hose of the prior art.
Figure 3:
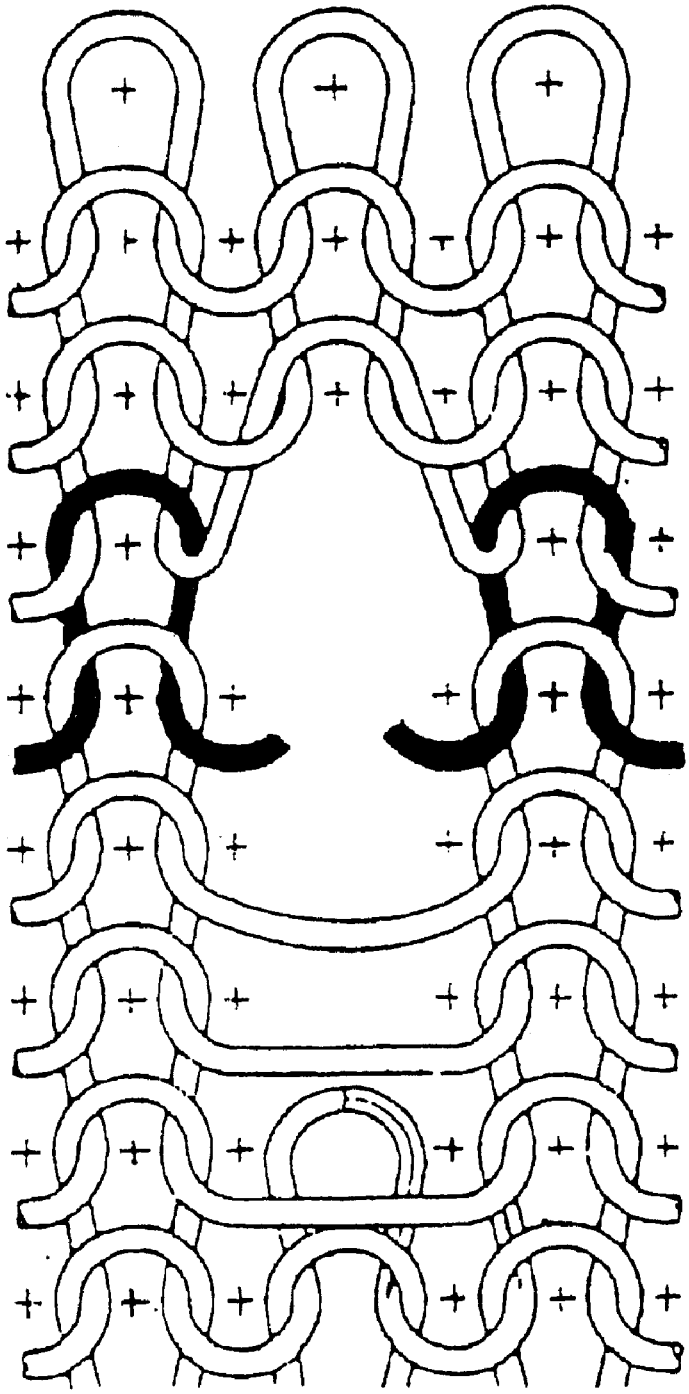
Figure 3 (PRIOR ART)
FIG. 3 is a schematic illustration of progression of a run in a prior art hose.
Figure 4:
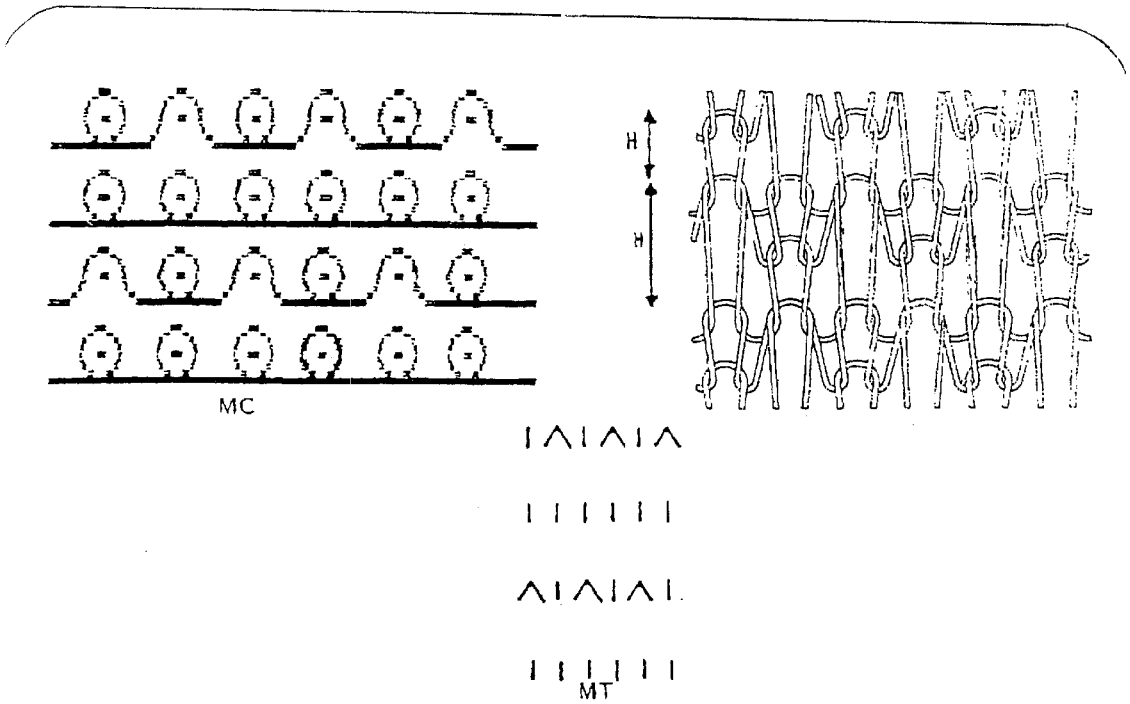
Figure 4 (PRIOR ART)
FIG. 4 is a schematic illustration of a loop-shaped mesh of the prior art.
Figure 5:
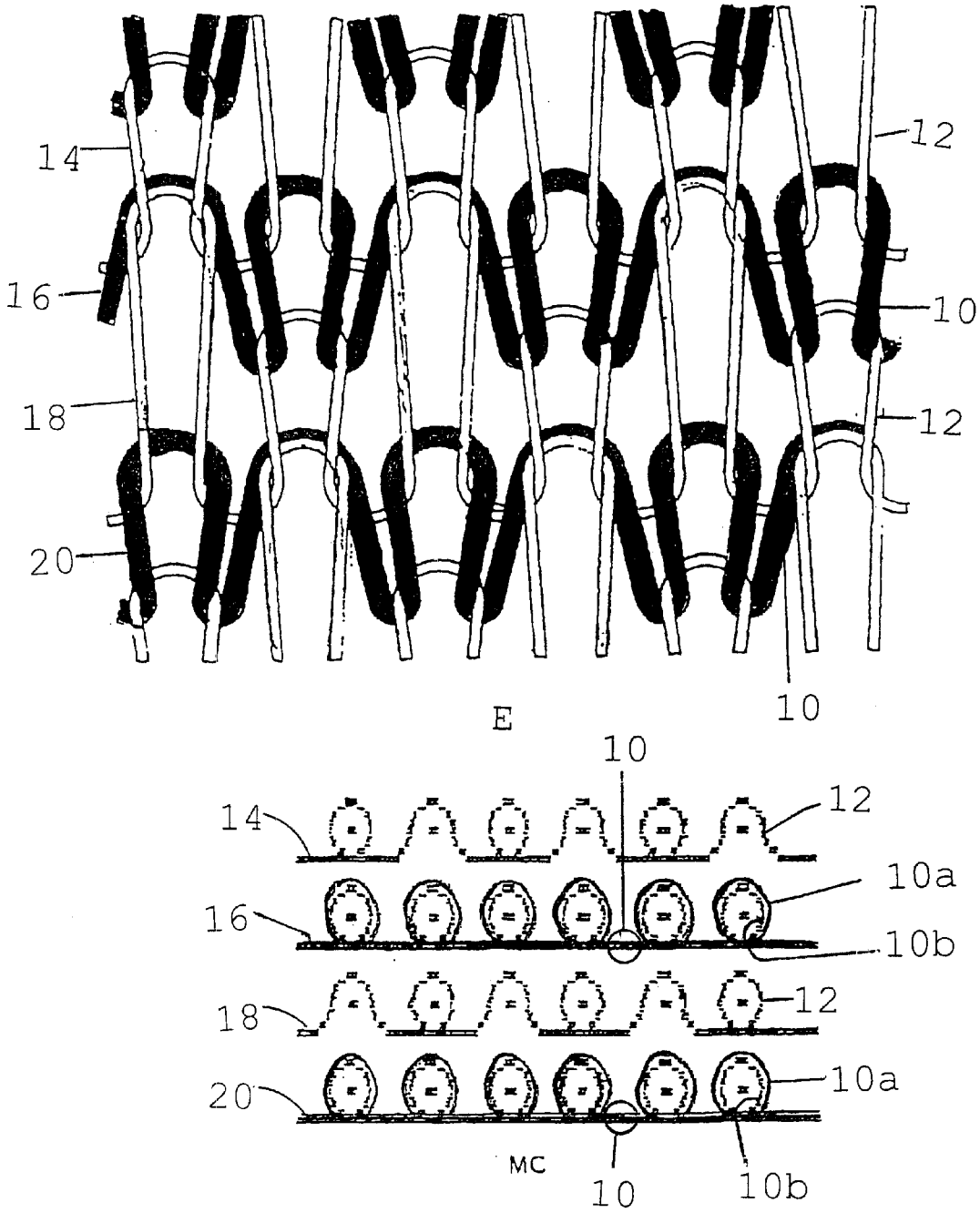
FIG. 5 is a schematic illustration of an embodiment of the present invention.

The formation of the mesh of "JOSÉ EISENBERG-LIFE SYSTEM" was achieved in the following manner: whereas in the fabrication of mesh by weft (the traditional run-free system) a single thread successively forms the links; with "JOSÉ EISENBERG-LIFE" the chain of the two threads (all other existing threads for weaving and elasthane), technically called plated, form the mesh simultaneously; in practice, with the only operation that of knitting, without the use of any special chemical product and without the use of a thread different from those used in the normal production of stockings and tights, we have arrived at the creation of a double-loop called, in fact, "dropped stitch" mesh. Seen clearly in FIG. 5 are the aforementioned notions and the specific function of the elasthane which tends to approach the smooth mesh (a tightening effect), thereby blocking the continuation of the run. At rest, the run-free JOSÉ EISENBERG-LIFE product, for example tights, may, in function of the type of thread used, seem shorter and may seem, to the touch, more compact and more supple in comparison to the traditional product but, in relation to the latter, it possesses the acknowledged characteristics of extensibility and elasticity which improve the quality and, above all, the wear.

In FIG. 5, the black thread corresponds to elasthane, while the red thread corresponds to all other existing threads for weaving. These two threads work in the knitting of smooth mesh.

As shown in FIG. 5, the loop-shaped mesh of the present invention includes an elasthane thread 10 that actually consists of two threads 10*a* and 10*b* (FIG. 5MC) and a second thread 12 that is not elasthane. The mesh has a first horizontal course 14 of the second thread 12, a second course 16 of the elasthane thread 10, a third course 18 of the second thread 12, and a fourth course 20 of the elasthane thread 10. The second course 16 is knit into the first course 14 and the third course 18 at every loop and the fourth course 20 is knit into the third course 18 at every loop. The third course 18 is also knit into the first course 14 at every other loop.

Figure 6:
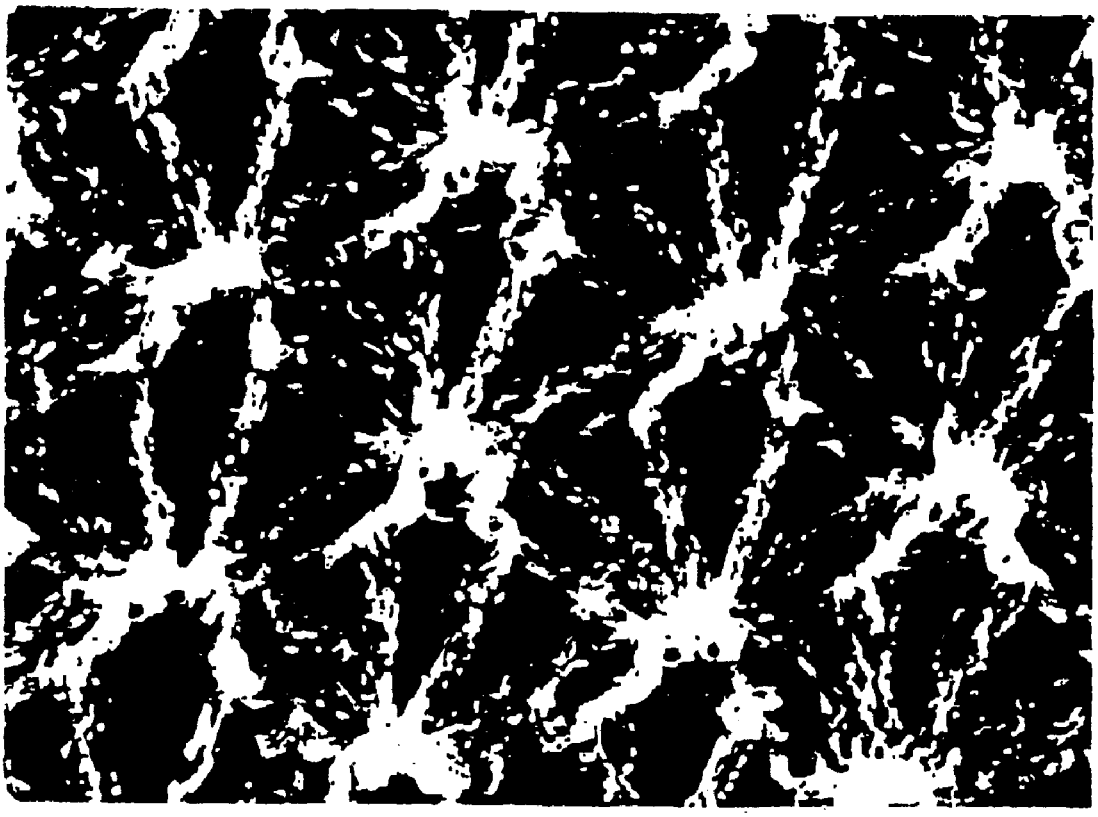
FIG. 6 is a depiction of the mesh knit of the present invention.

In FIG. 6, you see an enlargement of 20" of the mesh knit that we have created. One clearly sees the tight inter-mesh to the extremities of the threads of elasthane and all other existing threads for weaving: they descend to the smooth mesh just to the moment when they form real and individual "diamonds" at the ends of which are linked the loops of the second thread made of any other existing threads for weaving worked into the mesh. In the event of the breakage of one or several threads at any point in the weft, the friction that occurs at the meeting point of the threads prevents the dissolution of loops and the enlargement of the run in any direction.

In the figures, all of the illustrations marked with the letters MC are according to the C method, and those marked with the letters MT are according to the Tremelloni method.

Because of this invention, if one makes a hole in a run-free stocking or run-free tights, this hole will not expand and the stocking will not run. Run-free stockings and tights that have holes or are worn may continue to be used normally, as they will not run.

What is claimed is:

1. Run-free hosiery comprising:

a knit mesh of looped threads that include an elasthane thread and a second thread that is not elasthane, the knit mesh having a first course of the second thread, a second course having two threads together acting as a single thread, one of the two threads being the elasthane thread, a third course of the second thread, and a fourth course having two threads together acting as a single thread, one of the two threads being the elasthane thread, and the second course being knit into the first and third courses at every loop and the fourth course being knit into the third course at every loop, the third course being further knit into the first course at every other loop.

* * * * *

UNITED STATES PATENT AND TRADEMARK OFFICE

CERTIFICATE OF CORRECTION

PATENT NO. : 6,505,485 B1
DATED : January 14, 2003
INVENTOR(S) : José Eisenberg

It is certified that error appears in the above-identified patent and that said Letters Patent is hereby corrected as shown below:

Title page,
Item [12], amend to read as follows:
-- [12] Eisenberg --

Item [76], amend to read as follows:
-- [76] Inventor: José Eisenberg, 24, Avenue Princesse Grace, Monte-Carlo MC 98000 (MC) --

Signed and Sealed this

Fifteenth Day of July, 2003

JAMES E. ROGAN
*Director of the United States Patent and Trademark Office*